United States Patent [19]

Caron et al.

[11] 4,437,659

[45] Mar. 20, 1984

[54] ROTARY DRUM FOR PROCESSING SHEET MATERIALS

[75] Inventors: Christopher D. Caron, Longmont; Donald W. Schaefer, Lakewood, both of Colo.

[73] Assignee: International Business Machines Corporation, Armonk, N.Y.

[21] Appl. No.: 410,722

[22] Filed: Aug. 23, 1982

Related U.S. Application Data

[63] Continuation of Ser. No. 191,582, Sep. 29, 1980, abandoned.

[51] Int. Cl.[3] ..... B65H 29/32

[52] U.S. Cl. ..... 271/276; 271/196

[58] Field of Search ..... 271/276, 196, 94–96, 271/99

[56] References Cited

U.S. PATENT DOCUMENTS 4,145,040 3/1979 Huber ..... 271/276

4,234,305 11/1980 Miyake ..... 271/311 X

OTHER PUBLICATIONS

*IBM Technical Disclosure Bulletin*, vol. 19, No. 5, Oct. 1976, "Vacuum Transport Drum", by R. M. Glowa et al., pp. 1645–1646.

*Primary Examiner*—Richard A. Schacher

*Attorney, Agent, or Firm*—Francis A. Sirr; Joscelyn G. Cockburn

[57] ABSTRACT

A low inertia rotary drum supports flexible sheets of different sizes for transport and processing. A plurality of slots are disposed on the surface of the drum. The slots are configured in spaced relation along the longitudinal and circumferential dimension of the drum. A plurality of holes or communicating ports are disposed in the slots. The holes interconnect the interior of the drum with the surface. The number of holes varies circumferentially and longitudinally. A vacuum system having a relatively low vacuum and a relatively high flow rate is coupled to the interior of the drum. Sheets are loaded onto the drum so that a minimum number of holes are vented to the atmosphere.

7 Claims, 6 Drawing Figures

FIG. 2
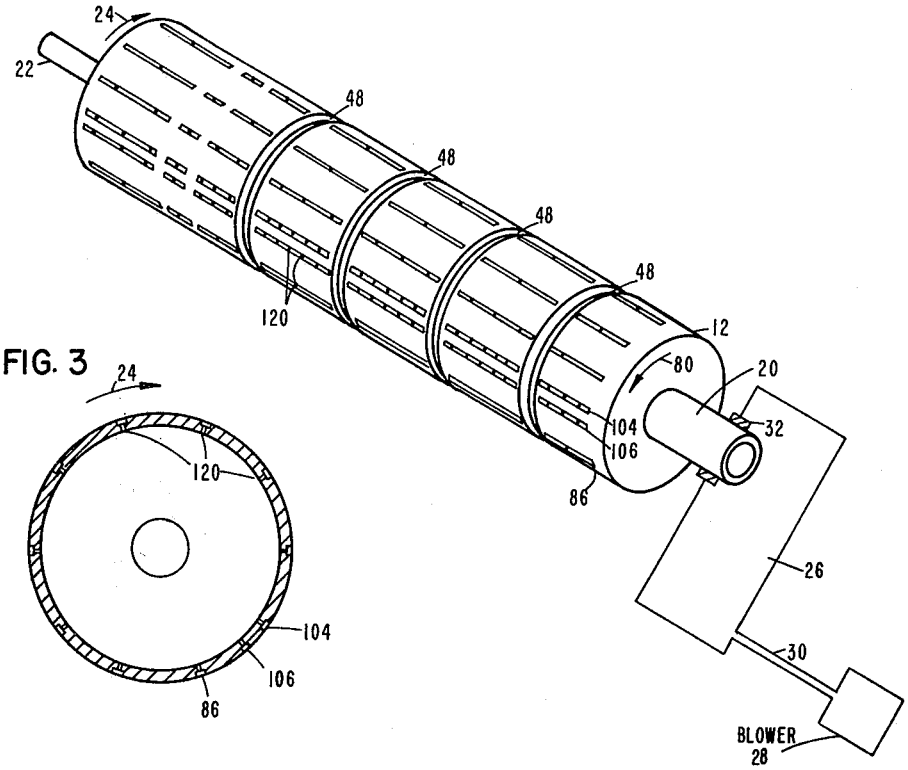
FIG. 3
FIG. 4
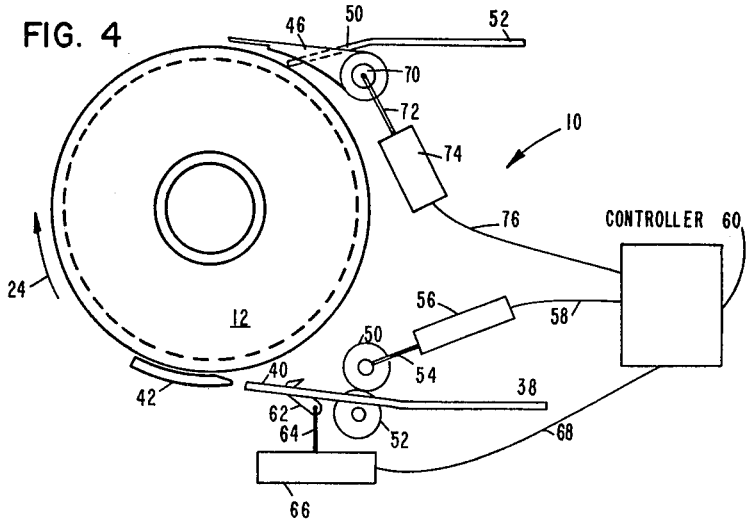

ROTARY DRUM FOR PROCESSING SHEET MATERIALS

CROSS-REFERENCES TO RELATED APPLICATIONS AND PATENTS

This is a continuation of Ser. No. 191,582, filed Sept. 29, 1980, now abandoned.

In the copending patent application of E. C. Korte for "Sheet Feeding and Transport" Ser. No. 766,403, filed Feb. 7, 1977 and assigned to the assignee of the present application (now abandoned, and whose continuation application is U.S. Pat. No. 4,252,307), there is shown a low inertia rotary drum for transport of flexible sheets such as paper. The drum has two longitudinal slots disposed on its surface, with each slot being connected to internal segments by spaced ports extending therethrough. These slots enable a vacuum to be applied to the leading and/or trailing edge of the sheet separately. A valving system is used to control the vacuum to these slots independently through the internal segments. The spacing of the slots about the circumference of the drum is dependent on the size of the sheet to be processed. A charge corona is disposed relative to the drum and attaches the sheet to the drum by means of electrostatic attraction.

The drum of the aforementioned invention handles a single size sheet and requires the use of a corona for attaching the sheet to the drum.

In U.S. Pat. No. 4,202,542, by G. B. Lammers, et al., Ser. No. 856,552, filed Dec. 1, 1977 and issued Dec. 4, 1979, entitled "Apparatus for Handling Flexible Sheet Material of Different Sizes," and assigned to the assignee of the present invention, there is shown a sheet transport device including a low inertia rotary drum for handling various size materials. The drum has a plurality of sets of longitudinally spaced ports formed on its surface. The ports are spaced arcuately from each other about the surface of the drum, with one set enabling a vacuum to be applied to the leading edge of a sheet, while only one of the other sets of ports applies a vacuum to the trailing edge of the sheet in accordance with the dimension of the sheet in the circumferential direction around the drum. The sheet transport device further controls how many of the ports of the two sets of ports apply a vacuum in accordance with the dimension of the paper along the length of the drum. A rotary valve is used to control the vacuum flow in accordance with the size of the sheet.

Thus, the drum of the invention processes various size sheets but requires a rotary valve for controlling vacuum flow.

The present invention is an improvement of the drum of the aforementioned patent and patent application in that the drum of the apparatus of the present invention does not require the use of a tacking corona and/or a valve for controlling vacuum. The drum of the present invention handles various size sheets and can be used with the structure described in either of the above-mentioned references.

BACKGROUND OF THE INVENTION

1. Field of the Invention

The present invention relates to document transport devices; more particularly, to drum type document transport devices wherein a sheet of flexible material (such as paper) is attached to the drum for transport and for processing.

2. Prior Art

The use of a rotary drum for transporting sheet-like material is well known in the prior art. The rotary drums are often used in printing systems. In addition to the transport function, these drums support the sheet-like material during the printing process. Prior art printing systems are further fitted with paper handling mechanisms which load and unload a sheet of paper onto the drum.

A necessary component of the prior art print system is the means used to attach the sheet onto the drum. The prior art often used mechanical fingers for clamping sheets onto the drum. By way of example, U.S. Pat. No. 2,451,079 describes a rotary drum for supporting a sheet in a facsimile printing system. The drum is fitted with two linear rows of pins. The rows of pins are spaced circumferentially and extend outwardly from the surface of the drum. One row of pins releasably secures the leading edge of the sheet while the other row releasably secures the trailing edge of the sheet. A loading plate and a stripper bar are positioned relative to the drum. The loading plate loads a sheet onto the drum while the stripper bar strips a sheet from the drum.

Although the above-described mechanical clamping system works satisfactorily for its intended purpose, the system tends to be relatively slow and complex. The slowness stems from the fact that the response time in which the mechanical system clamps and releases a sheet is relatively long. As such, the print drums using mechanical fingers for gripping the sheet are used with relatively low performance printing systems.

For high performance printing systems, the prior art generally uses pneumatics and/or electrostatic means for tacking the sheet onto the drum. Prior art printing systems generally use coronas as the source for generating the electrostatic force. An example of a prior art printing system using a combination of pneumatics and corona for attaching a sheet onto a print drum is disclosed in the above-referenced Korte patent application.

As for pneumatic systems, the general scheme is to use a segmented drum to transport the sheet. Vacuum for attaching and/or dislodging the sheet is selectively applied to various zones or segments on the drum. The drum is referred to as being segmented because at times during the operation of the system, segments of the drum may or may not have vacuum present.

U.S. Pat. No. 3,545,746 is an example of the prior art segmented drum. The patent describes a document transport consisting of a hollow cylindrical transport drum and document loading and unloading means disposed relative thereto. The cylindrical surface of the drum is fitted with longitudinal and circumferential slots. The inside of the drum is vented to atmosphere by communicating holes. A static partition divides the interior of the drum into two pneumatically independent compartments. By rotating the drum and applying a vacuum to one of the compartments, a document can be carried around with it, to a limited extent, determined by the size of the evacuated compartment.

U.S. Pat. No. 4,145,040 is another example of the prior art segmented type vacuum drum. The drum is adapted for transporting flexible sheets. The drum is fabricated with an active suction zone or sector for gripping the sheets. The drum consists of an inner stationary cylindrical member and an outer rotary cylindrical member. The stationary member is fitted with a suction source and a pressure source. Both sources are displaced relative to each other about the circumference of the stationary cylindrical member. The suction source is vented through a groove to the outside surface of the inner stationary member. Likewise, the pressure source is vented through a recess formed on the surface of the inner stationary member. A sector of the outer rotary member is fitted with rows of apertures. The apertures interconnect the inside surface of the stationary member to the outside surface. A common duct interconnects a row of apertures to the groove or the recess. Each duct is fitted with a piston. The piston controls the pressure (negative or positive) to the apertures. Vacuum (negative pressure) and/or puffs of air (positive pressure) is applied to the sector of the drum as the outer member is rotated relative to the inner.

It is also well known in the prior art to use valves as a means to control vacuum flow to the active segment of the drum. By way of example, U.S. Pat. Nos. 3,663,012 and 3,466,029 describes sectored vacuum transport drums wherein valves are used to control vacuum to the active sector of the drum.

Although the use of pneumatics or a combination of pneumatics and electrostatics is a significant improvement over the use of mechanical gadgets for tacking sheets onto a drum, the prior art pneumatic document transport systems still have several disadvantages. In the first instance, the segmented drum design tends to be complex. The complexity increases as the number of sheet sizes, which the transport system handles, increases.

A complex valving system is generally needed in the prior art pneumatic systems. The valving system is needed to select which port receives flow at any particular time. The valving system increases as the sheet size, which the system handles, increases. Another requirement for a valving system is that the system must know the paper size to enable the supply of vacuum to the proper ports. This requires the intervention of an operator to make a sheet size selection or the use of logic to detect the sheet size. Moreover, with a valving system, one has to use extra care in selecting the valve and in positioning it relative to the drum. Both valve selection and valve positioning are important since the response time of the drum is directly dependent on both variables. Due to their complexity, the prior art pneumatic document transport system has relatively low reliability.

Another prior art problem area is in the type of vacuum system used. As was described previously, the vacuum system is needed to evacuate the drum. Stated another way, the vacuum system creates the force for tacking a sheet onto the drum. The problem in this area stems from the fact that in that type of vacuum system, there is a wide swing in the vacuum between load and no-load conditions on the drum. By way of example, at no-load condition (that is with no paper on the drum), the vacuum is relatively low. At load condition (that is with paper on the drum), the vacuum is substantially higher.

The wide swing in vacuum has several undesirable repercussions. In the first instance, there is a large mismatch between the vacuum requirements to attach and retain a sheet onto the drum. Generally, a relatively high flow is required for attachment, but a relatively low vacuum force is required for retainment. As such, there is a need to recognize that there is a close relationship between the vacuum system which generates the vacuum requirements and to design the vacuum system to minimize the mismatch.

So far, the prior art has failed to recognize and address the interrelation between the vacuum requirements (at the drum) and the design of the vacuum system.

In addition, the high vacuum tends to damage a sheet on the drum. More important, in some types of application, such as ink jet printing, the high vacuum is totally unacceptable. The reason is that the high vacuum sucks the ink through the paper. The prior art attempts to solve the problem by using a relief valve to reduce the pressure at the drum. Needless to say, the use of the relief valve tends to complicate the system and increase cost.

SUMMARY OF THE INVENTION

An object of this invention is to provide a more efficient sheet handling apparatus than was heretofore designed.

Another object of the present invention is to provide a nonsegmented drum for handling various size sheets.

Still another object is to provide a vacuum drum with a relatively uniform vacuum between load and no-load conditions.

The present invention accomplishes the foregoing by generating variable flow zones on the surface of the drum during loading and variable vacuum force zones on the surface of the drum during the period of time when the sheet is retained on said drum. The vacuum force and flow zones are highest at predetermined zones; particularly, in the zones whereat the leading and trailing edge of the sheet attaches to the drum. The vacuum and flow are generated by slots and communicating ports disposed on the surface of the drum. By varying the sizes of the slots and the number and/or size of holes, the variable vacuum force and flow zones are created.

The present sheet handling apparatus includes a low inertia rotary drum which supports variable size sheets of paper. The drum is journaled at its opposite ends for rotation. A plurality of spaced elongated slots are fabricated on the cylindrical surface of the drum. The slots are placed along the longitudinal and circumferential dimensions of the drum. The slots, along the longitudinal dimension of the drum, are configured to support three sizes of sheets. The slots around the circumference of the drum are configured into a leading edge slot and a plurality of trailing edge slots. The leading edge slot supports the leading edge of all sized sheets, while each trailing edge slot supports the trailing edge of a different sized sheet. The spacings between the leading edge slots and the trailing edge slots are dictated by the size of the sheets. A high flow, low vacuum blower is coupled to the drum. Communicating ports or holes are fabricated in the slots. The holes communicate the vacuum to the surface of the drum.

In one feature of the invention, one or more arcuate slots are disposed in the circumferential dimension of the drum. One or more pick-off fingers coact with the slots to strip a sheet from said drum.

In another feature of the invention, the population and/or size of the holes are greatest in the leading and trailing edge slots.

In yet another feature of the invention, an elongated load guide is disposed relative to the surface of the drum. The guide forces a sheet to conform to the surface of the drum.

The foregoing and other features and advantages of the invention will be apparent from the following more particular description of the preferred embodiment of the invention, as illustrated in the accompanying drawings.

DESCRIPTION OF THE DRAWINGS

FIG. 2 shows a schematic of the print drum.

FIG. 3 shows a cross-sectional view of the print drum.

FIG. 4 shows a cross-sectional view of the document handling apparatus.

DETAILED DESCRIPTION OF THE PREFERRED EMBODIMENT

As is used in the specification, the word "pump" means a type of air compressor characterized as a high pressure, low mass flow rate device usually of the positive displacement type.

As is used in the specification, the word "blower" means a type of air compressor characterized as a high mass flow rate device usually of the nonpositive displacement (dynamic) type.

Although the present invention can be used in any environment wherein flexible sheet-like materials are transported, the invention is well suited for use in a printing environment, and as such, will be described accordingly. However, this should not be construed as a limitation on the scope of the present invention since it is within the skill of the art to adapt the invention for use in other environments without departing from the scope and spirit of the present invention.

Figure 1:
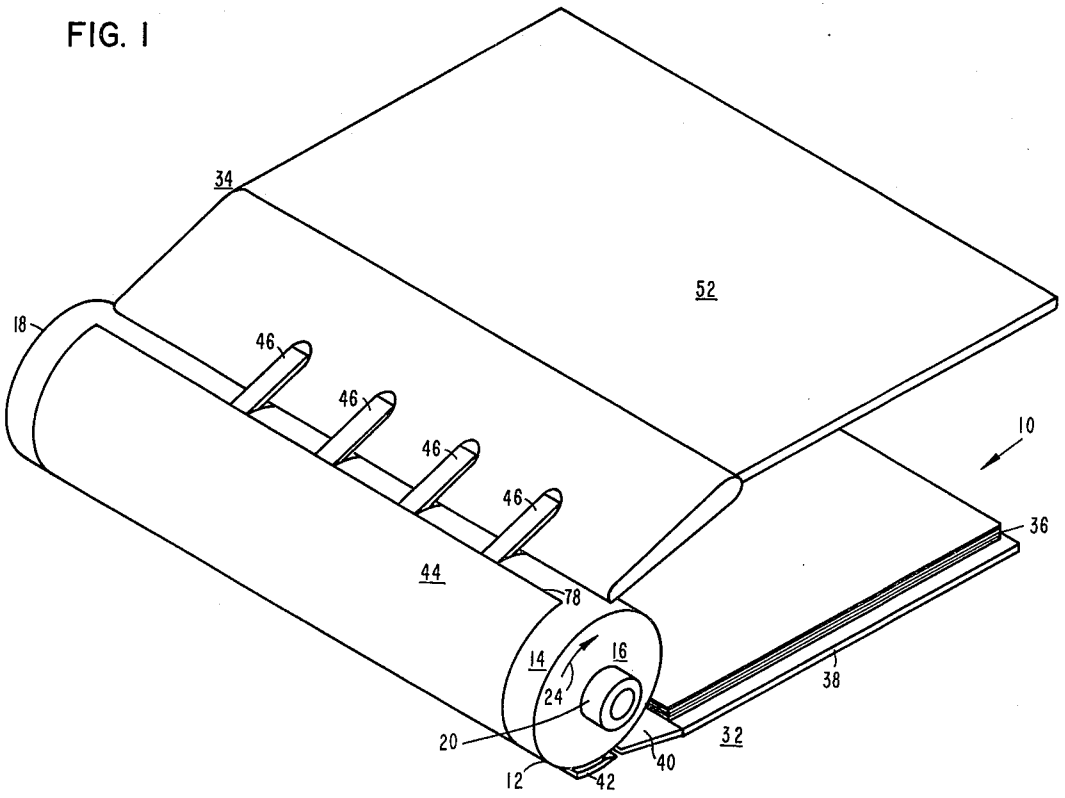
FIG. 1 is a schematic view of the document handling apparatus according to the teaching of the present invention.

Referring to the drawings, and particularly to FIGS. 1 and 4, there is shown a document handling system 10 according to the teaching of the present invention. For brevity of description, common elements in the figures will be identified by common numerals. Also, conventional elements such as support frame, mechanical coupling, bearings, etc. are omitted from the drawings. It is believed that the omitted elements can be easily supplied by an artisan having ordinary skill in the mechanical art, and the omission further simplifies the description of the invention shown in the drawings and described hereinafter.

The document handling system 10 includes a low inertia rotary drum 12. The drum includes a cylindrical shell 14 with end members 16 and 18 fixedly attached to opposite ends of the cylindrical shell. A tubular member 20 is securely fastened into end member 16. As will be described subsequently, the tubular member 20 conveys negative pressure to the interior of drum 12. As is shown more clearly in FIG. 2, a shaft 22 is attached to end member 18. A pair of conventional bearings and mechanical couplings (not shown) are coupled to shaft 22 and tube 20, respectively. The bearing is securely attached to the machine frame (not shown). A drive motor (not shown) is coupled to shaft 22. The drum is therefore journaled for rotation in the bearings (not shown) and is driven by the motor (not shown) in a direction shown by arrow 24. A vacuum plenum 26 is coupled to tubular member 20. A blower 28 is coupled to the plenum through tube 30. As will be described hereinafter, the interior of drum 12 is evacuated by the blower. A seal member 32 is positioned about tube 20 and prevents escape of negative pressure to the atmosphere. In the preferred embodiment of this invention, the blower is a low vacuum, high volume flow blower.

Still referring to FIG. 1, a loading station 32 and an unloading station 34 are positioned relative to the surface of the rotating drum. The function of the loading station 32 is to load flexible sheet-like material such as paper sheets, in seriatim from a stack 36 of sheets loaded in support tray 38. The topmost sheet in the pile is fed along guide channel 40 where the leading edge of the sheet is first attached to a predetermined zone on the cylindrical surface of the drum. Downstream from the loading zone, in the direction of drum rotation, an arcuate elongated guide member 42 is mounted relative to the cylindrical surface of the drum. The function of the guide member is to force a sheet to conform to the surface of drum 12. The guide member has a length substantially equivalent to the length of the drum and runs in a direction parallel to the axis of rotation of said drum. In the preferred embodiment of this invention, the spaces between the cylindrical surface of the drum and the inner surface of the guide member is approximately 0.05 centimeters. As is shown in FIG. 1, a paper sheet 44 is securely attached to the cylindrical surface of the drum. The sheet on the drum is processed by a processing station (not shown) which is positioned relative to the drum and between the loading and unloading stations. The processing station may be an ink jet head which writes readable characters on the paper as said paper is transported through the processing station. After processing, the sheet 44 and other sheets similarly situated are stripped from the drum by a plurality of stripping fingers 46. As is shown more clearly in FIG. 2, these stripping fingers are lowered to coact with a plurality of circumferential slots 48 fabricated in the circumferential dimension of the drum. The detached sheets travel over the top surface of guide member 50 and into output tray 52.

An operator can then remove the processed sheet from the output tray. It should be noted that although a plurality of circumferential slots and a plurality of mechanical fingers are used to detach the sheet from the drum, in a preferred embodiment of this invention, only a single slot and a single detach finger is used. It is therefore obvious that any number of slots and associated fingers can be used to detach the processed sheet from the surface of the drum.

Turning now to FIG. 4 is a cross-section of the schematic shown in FIG. 1. As was stated previously, elements in this schematic which are common with elements previously identified in FIG. 1 are identified by the same numerals. As was described previously, the sheets (not shown) are fed in seriatim from support tray 38 along guide channel 40 and onto the cylindrical surface of drum 12. Loading of the sheet is assisted by elongated guide member 42. A pair of feed rollers 50 and 52, respectively, are disposed within the feed path of the sheet. The guide rollers are mounted so that a relatively small opening separates the rollers. The opening is sufficiently small to allow free passage of a sheet therebetween. Feed roller 50 is coupled through a mechanical linkage 54 to solenoid 56. The solenoid is connected by conductor 58 to controller 60. As will be described subsequently, when a control signal is outputted on conductor 58, the solenoid pivots roller 50 to clamp a sheet positioned between rollers 50 and 52, respectively. The sheet is subsequently fed onto the surface of the drum.

A paper gate 62 is pivotally mounted in the paper path and downstream from feed rollers 50 and 52, respectively. The paper gate is coupled through a mechanical linkage 64 to a solenoid 66. The solenoid is coupled by conductor 68 into controller 60. In operation, a sheet of paper (not shown) is fed from the top of a paper stack in bin 38 by a feed mechanism (not shown). By way of example, a paper feed mechanism referred to as a shingler and described in U.S. Pat. Nos. 4,113,245 and 4,175,741 may be the paper feed means. The paper passes through the opening between feed rollers 50 and 52 and the leading edge is stopped by paper gate 62. Enabling signals are outputted on conductors 58 and 68, respectively. The signal on conductor 68 activates solenoid 66. As a result of the actuation, the gate 62 is pivoted from the leading edge of the sheet. Similarly, the signal on conductor 58 activates solenoid 56. Solenoid 56 then forces feed roller 50 to lower, thereby forcing contact of the sheet with both rollers. The roller 52 is then rotated by a rotating means (not shown) in a counterclockwise direction, thereby feeding the sheet onto the cylindrical surface of drum 12 synchronized in position and surface velocity with the drum. Generally, the drum slows down during loading, speeds up during processing and again slows down when a sheet is to be removed therefrom. Stated another way, paper is delivered to the drum at a first velocity. Paper is processed on the drum at a second velocity. Usually the second velocity is higher than the first.

Still referring to FIG. 4, pick-off fingers 46 are fabricated with an upper sloping surface and are substantially cone-shaped with the bottom surface of the cone having concave surface for coacting with the circumference of the drum. The pick-off fingers are fixedly coupled to shaft 70. Shaft 70 is coupled through mechanical linkage 72 to solenoid 74. Conductor 76 connects the solenoid to controller 60. In operation, a control signal is outputted on conductor 76 from controller 60. The signal activates solenoid 74 and the shaft 70 is rotated in a counterclockwise direction so that the pick-off fingers are lowered into slots 48. Of course, if a single slot and pick-off finger is used, then the pick-off finger is lowered in the single slot. As such, a sheet which is on the drum rides along the upper incline surface of pick-off finger 48 over guide member 50 and into tray 52. It should be noted, at this point, that several other types of loading devices may be used without departing from the scope of the present invention. By way of example, the loading mechanism described in accordance with the above cross-referenced Korte application may be the loading mechanism. Similarly, other types of unloading mechanisms can be used to unload a sheet from the drum.

Figure 5:
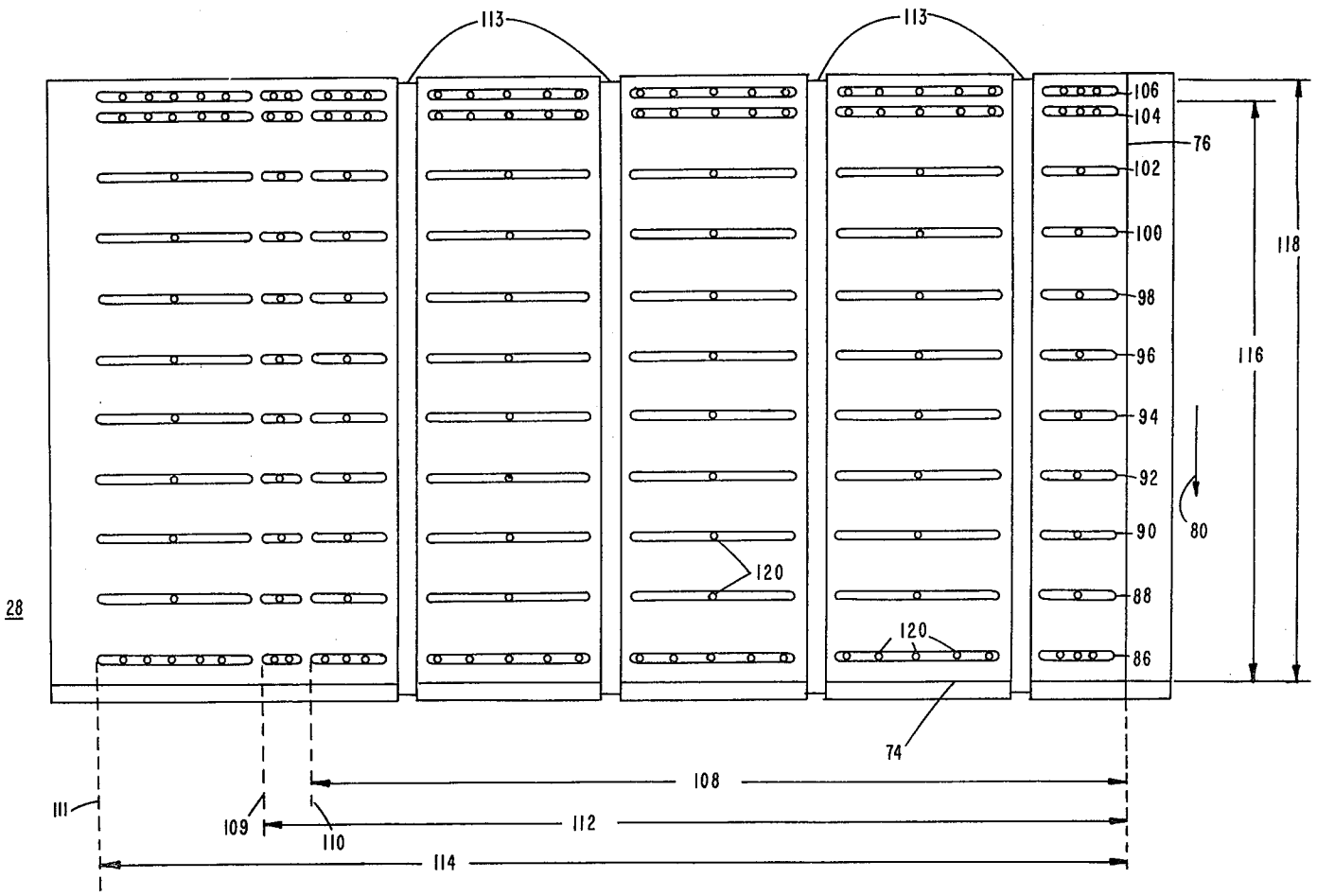
FIG. 5 is a schematic view of the vacuum drum unfolded. The view is helpful in understanding the layout of the slots and communicating ports on the surface of the drum.

As was stated previously, the means which are used to attach a sheet onto the drum is vacuum. As is shown in FIGS. 2, 3 and 5, a plurality of slots and holes are used for controlling and communicating the vacuum to the surface of drum 12. In FIG. 2, the drum is shown in its normal (that is rolled) form. In FIG. 3, a cross-section of the drum of FIG. 2 is shown. In FIG. 5, the drum is shown in an unrolled form. In the unrolled representation form, the drum occupies a flat rectangular area. It is believed that the showing in FIG. 5 will highlight the structure by the slots and communicating ports. The structure enables variable force vacuum zones to be present on the cylindrical surface of the drum. No valving or other prior art segmenting are needed to establish the variable force vacuum zones on the drum. As before, common elements in the figures will be identified by common numerals. As can be seen in the drawings, the drum is fitted with a longitudinal scribe line 74 and a circumferential scribe line 76. The scribe lines are the alignment lines on the drum. Generally, the leading edge 78 (FIG. 1) of the sheet is aligned relative to or parallel with scribe line 74. Drum rotation is in the direction shown by arrow 80. The lengthwise dimension of the sheet is usually aligned with the longitudinal scribe line. Similarly, the widthwise direction of the sheet is usually aligned with circumferential scribe line 76. It should be noted that the alignment of the sheet may be reversed without departing from the scope of the present invention.

Still referring to FIGS. 2, 3 and 5, the entire cylindrical surface of the drum has a plurality of elongated slots fabricated thereon. The function of the slots is to allow the vacuum to be effective over a wide area of paper. The slots are arranged in linear rows and in spaced relation along the longitudinal axis and the circumferential axis of the drum. For ease of description, the slots are numbered in descending order in the direction opposite to that of the drum's rotation. By way of example, slot 86 is identified as the leading edge slot. This slot generates the vacuum force which attaches the leading edge of the sheet to the drum. Slots 88–102 are the intermediate slots and function to attach the center part of the sheet onto the drum. Slots 104 and 106 are the trailing edge slots. The function of these slots is to attach the trailing edge of a sheet onto the drum. Additionally, the width (size) of the slots vary. More particularly, the leading edge slots 86 are wider than the intermediate slots 88–102. Similarly, the trailing edge slots 104 and 106 are wider than the intermediate slots. This enables a slightly higher vacuum force to be present at the leading and trailing edges of the sheet.

Still referring to FIGS. 2, 3 and 5, the slots are configured in spaced linear rows along the longitudinal and the circumferential dimension of the drum. Also, the slots are configured into groups or sets, both in the longitudinal dimension and the circumferential dimension of the drum. Each set or group is adapted for supporting a different size sheet. By way of example, the first group of slots (identified by numbers 108 and 118) extends along the longitudinal dimension of the drum and is positioned between scribe line 76 and dotted line 110. The first group of slots also extend in the circumferential dimension of the drum and are bound by scribe line 74 and trailing edge slot 106. The first group of slots support a first size sheet, say $8\frac{1}{2}'' \times 11''$.

Likewise the second set of slots (identified by numerals 112 and 116) are bound in the circumferential dimension of the drum by scribe line 74 and trailing edge slot 104. In the longitudinal dimension, the second set is bound by dotted line 109 and scribe line 76. The second group of slots support a second size of sheet, say the international paper A4. The size of the A4 paper is approximately $210 \times 297$ mm or $8\frac{1}{4}'' \times 11.7''$.

Finally the third set of slots (identified by numerals 114 and 118) support a third size of sheets, say, 8½"×14" sized sheet.

The third set of slots are bound along the longitudinal dimension by dotted line 111 and scribe line 76 and in the circumferential direction by scribe line 74 and trailing edge slot 106. Although FIG. 5 shows that the drum is able to support three different sizes of sheets, this should not be construed as a limitation on the scope of the present invention. Since it is within the skill of the art to design the drum's surface so that more than or fewer than three sizes of sheets can be supported. In other words, the slots can be configured to support variable size sheets.

As is evident from the above description, the circumferential dimension of the drum supports sheets having a specific width (say 8½"). Likewise, the distance identified as 116 supports sheets having a second width such as the so-called A-4 paper. The A-4 paper is the designation given to an internationally sized paper. Of course, any other configuration can be designed for supporting other types of sheets without departing from the scope of the present invention.

A plurality of circumferential slots 113 are disposed around the circumference of the drum. The detach finger coacts with the circumferential slots to remove a sheet from the drum. Although a plurality of slots are shown in FIG. 5, in one embodiment of the present invention only a single slot is used.

Still referring to FIGS. 2, 3 and 5, a plurality of communicating ports 120 are fabricated in the cylindrical surface of the drum. The communicating ports, sometimes called holes, interconnect the interior of the drum to the cylindrical surface. The function of these holes is to supply vacuum from the interior of the drum to the external surface. The population and/or size of these holes are such that variable flow zones are generated on the cylindrical surface of the drum. As is shown in the figures, a relatively high number (population) and/or size of holes are shown in the leading edge slot 86. As such, a relatively high flow which attaches the leading edge of the sheet is experienced in this zone. Similarly, a relatively high number and/or size of holes are disposed in trailing edge slots 104 and 106, respectively. As such a relatively high flow for attaching the trailing edge of the sheets is experienced in the trailing zone.

The population of holes in the intermediate slots 88–102 are scanty and therefore a relatively low flow zone is positioned between these rows. Stated another way, there are fewer holes in the intermediate slots then there are in the leading edge slot and/or the trailing edge slots. Although not shown in FIG. 5, in a preferred embodiment of the present invention, the population and/or size of holes in the trailing edge slots are greater than those in the leading edge slots. This creates a higher flow (attraction) zone at the trailing edge of the sheets than at the leading edge.

It should be noted that the leading and trailing edge zones on the drum are the most critical areas for attachment and retainment of a sheet. For attachment of the sheet's leading and trailing edges, high flow is required which is provided by a large port flow area (i.e., number of holes and/or size). For retainment of the sheet's leading and trailing edges, a certain vacuum force is required which is provided by wide slots. Zones interior to the leading and trailing edge zones have lower flow and vacuum force requirements for attachment and retainment. These zones only need a low flow and a low vacuum force which are provided by smaller port flow areas and narrower slots respectively. The type of vacuum system used in the present invention interacts with these slots widths and port flow areas to satisfy the different zone attachment and retainment requirements. This is done more effectively at both load and no-load conditions.

Although the showing in FIGS. 2, 3 and 5 shows a particular combination of slots and holes for a particular design, these should not limit the scope of the present invention. It should be understood that the number of holes, the number of slots, the sizes of the holes and the sizes of the slots can be amended by one having ordinary skill in this art without departing from the scope of the present invention. By way of example, the following table shows a listing of hole size, slot size, etc. for a typical drum. However, it should be understood that it is within the skill of the art to change these numbers without departing from the scope of the present invention.

TABLE I

| | | | DISPLACEMENT | | | | | | | | | | | | | |
|---|---|---|---|---|---|---|---|---|---|---|---|---|---|---|---|---|
| | | CIRCUMFERENCE | LONGITUDINAL (mm) | | | | | | | LENGTH (mm) | | | | | | |
| | WIDTH (mm) | SLOT CENTER-LINE (°) | SEG 1 | SEG 2 | SEG 3 | SEG 4 | SEG 5 | SEG 6 | SEG 7 | SEG 1 | SEG 2 | SEG 3 | SEG 4 | SEG 5 | SEG 6 | SEG 7 |
| Row 86 | 2.25 | 3.5 | 2.3 | 38.8 | 108.8 | 178.8 | 248.8 | 279.0 | 295.3 | 27.9 | 61.4 | 61.4 | 61.4 | 28.7 | 14.8 | 58.2 |
| Row 88 | 1.50 | 39.3 | 2.3 | 38.8 | 108.8 | 178.8 | 248.8 | 279.0 | 295.3 | 27.9 | 61.4 | 61.4 | 61.4 | 28.7 | 14.8 | 58.2 |
| Row 90 | 1.50 | 75.2 | 2.3 | 38.8 | 108.8 | 178.8 | 248.8 | 279.0 | 295.3 | 27.9 | 61.4 | 61.4 | 61.4 | 28.7 | 14.8 | 58.2 |
| Row 92 | 1.50 | 111.0 | 2.3 | 38.8 | 108.8 | 178.8 | 248.8 | 279.0 | 295.3 | 27.9 | 61.4 | 61.4 | 61.4 | 28.7 | 14.8 | 58.2 |
| Row 94 | 1.50 | 146.9 | 2.3 | 38.8 | 108.8 | 178.8 | 248.8 | 279.0 | 295.3 | 27.9 | 61.4 | 61.4 | 61.4 | 28.7 | 14.8 | 58.2 |
| Row 96 | 1.50 | 183.5 | 2.3 | 38.8 | 108.8 | 178.8 | 248.8 | 279.0 | 295.3 | 27.9 | 61.4 | 61.4 | 61.4 | 28.7 | 14.8 | 58.2 |
| Row 98 | 1.50 | 219.3 | 2.3 | 38.8 | 108.8 | 178.8 | 248.8 | 279.0 | 295.3 | 27.9 | 61.4 | 61.4 | 61.4 | 28.7 | 14.8 | 58.2 |
| Row 100 | 1.50 | 255.2 | 2.3 | 38.8 | 108.8 | 178.8 | 248.8 | 279.0 | 295.3 | 27.9 | 61.4 | 61.4 | 61.4 | 28.7 | 14.8 | 58.2 |
| Row 102 | 1.50 | 291.0 | 2.3 | 38.8 | 108.8 | 178.8 | 248.8 | 279.0 | 295.3 | 27.9 | 61.4 | 61.4 | 61.4 | 28.7 | 14.8 | 58.2 |
| Row 104 | 2.25 | 316.0 | 2.3 | 38.8 | 108.8 | 178.8 | 248.8 | 279.0 | 295.3 | 27.9 | 61.4 | 61.4 | 61.4 | 28.7 | 14.8 | 58.2 |
| Row 106 | 2.25 | 326.9 | 2.3 | 38.8 | 108.8 | 178.8 | 248.8 | 279.0 | 295.3 | 27.9 | 61.4 | 61.4 | 61.4 | 28.7 | 14.8 | 58.2 |

TABLE 2

| | DIAMETER (mm) | TOTAL POPULATION | POPULATION PER SEGMENT | | | | | | |
|---|---|---|---|---|---|---|---|---|---|
| | | | SEG 1 | SEG 2 | SEG 3 | SEG 4 | SEG 5 | SEG 6 | SEG 7 |
| Row 86 | 1.2 | 28 | 3 | 5 | 5 | 5 | 3 | 2 | 5 |
| Row 88 | 1.0 | 7 | 1 | 1 | 1 | 1 | 1 | 1 | 1 |
| Row 90 | 1.0 | 7 | 1 | 1 | 1 | 1 | 1 | 1 | 1 |
| Row 92 | 1.0 | 7 | 1 | 1 | 1 | 1 | 1 | 1 | 1 |
| Row 94 | 1.0 | 7 | 1 | 1 | 1 | 1 | 1 | 1 | 1 |

TABLE 2-continued

| | DIAMETER (mm) | TOTAL POPULATION | POPULATION PER SEGMENT | | | | | | |
|---|---|---|---|---|---|---|---|---|---|
| | | | SEG 1 | SEG 2 | SEG 3 | SEG 4 | SEG 5 | SEG 6 | SEG 7 |
| Row 96 | 1.0 | 7 | 1 | 1 | 1 | 1 | 1 | 1 | 1 |
| Row 98 | 1.0 | 7 | 1 | 1 | 1 | 1 | 1 | 1 | 1 |
| Row 100 | 1.0 | 7 | 1 | 1 | 1 | 1 | 1 | 1 | 1 |
| Row 102 | 1.0 | 7 | 1 | 1 | 1 | 1 | 1 | 1 | 1 |
| Row 104 | 1.2 | 28 | 3 | 5 | 5 | 5 | 3 | 2 | 5 |
| Row 106 | 1.2 | 28 | 3 | 5 | 5 | 5 | 3 | 2 | 5 |

Table 1 gives the details for the slots. The table should be read in conjunction with FIG. 5. The rows in the table and figure are numbered 86 through 106. The columns in the table represent various characteristics of the slots. Counting from left to right, column 1 gives detail for the width of the slots. Column 2 represents slot's displacement in the circumferential (CIR) and longitudinal dimension of the drum. The circumferential displacement is measured in degrees beginning at the scribe line 74. The longitudinal displacement is measured in other linear units beginning from scribe line 76. Segment (SEG) 1 is the first segment next to the scribe line 76. SEG 2 is next to 1 and so on. Column 3 represents the linear measurement for each segment.

Table 2 gives the details for the communicating ports. In this table, column 1 gives the diameter for the communicating ports. Total population gives the total number of communicating ports per row. The other columns give the number of communicating ports per segment.

Figure 6:
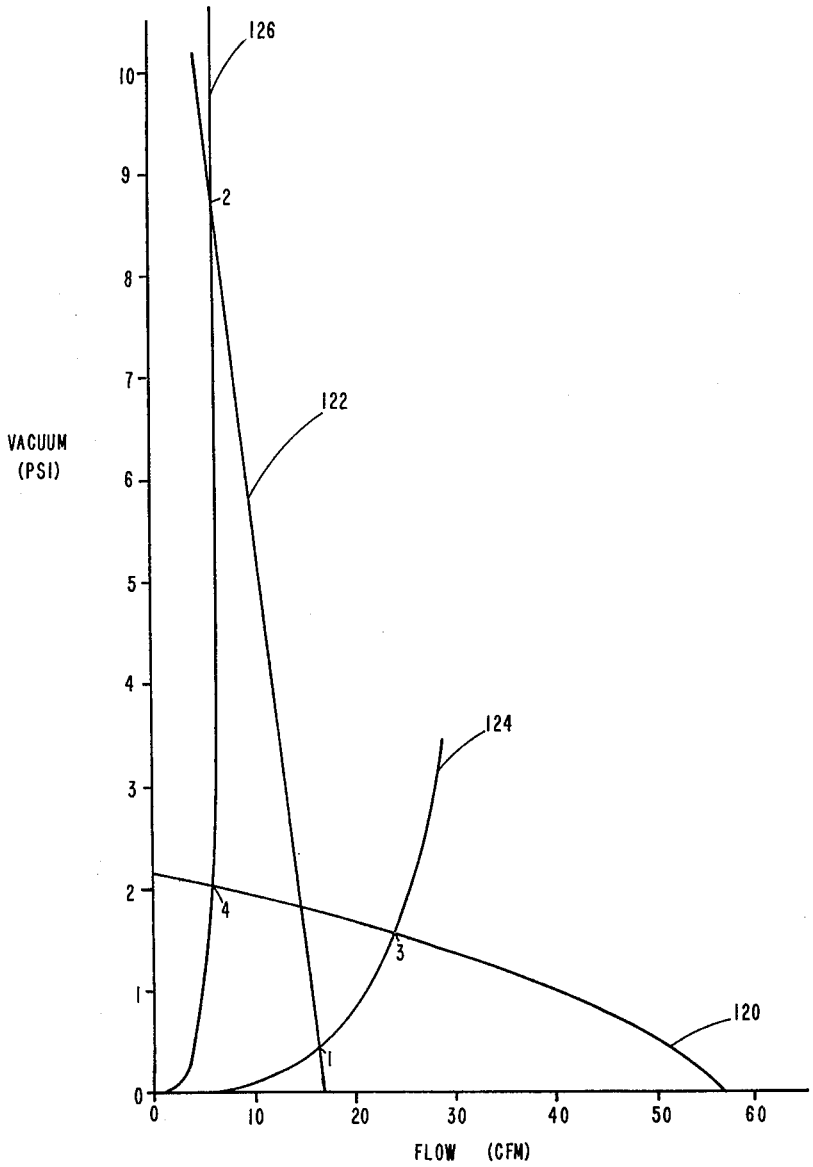
FIG. 6 is a graph showing the characteristics of various vacuum systems. The graph is helpful in understanding the design of an efficient vacuum system.

Referring now to FIG. 6 is a graph showing the relationship between the traditional vacuum pump (used in evacuating vacuum system of the prior art) and a blower suitable for use in the present invention. This graph is helpful in understanding the fluctuation in vacuum experienced on the surface of the rotary drum. It is also helpful in understanding the problem previously described relative to the evacuating vacuum systems of the prior art. In FIG. 6, vacuum pressure in pound per square inches (PSI) is plotted along the ordinate of the graph. Similarly, the flow in cubic foot per minute (CFM) is plotted along the abscissa of the graph. Curve 120 represents the characteristics operating curve for a 0.9 horsepower (HP) blower. Similarly, curve 122 represents the operating characteristics curve for a 1.0 horsepower (HP) vacuum pump. As is seen from the graph, the vacuum pump operating characteristic curve to a substantial extent, parallels the ordinate of the graph. Stated another way, the pump has a relatively low flow with a relatively high vacuum. The characteristic curve of the blower, however, has a relatively high flow with relatively low vacuum. Data for the characteristic curves of the blower and vacuum pump of similar power, are obtained from the respective manufacturers. Curve 124 represents the characteristic curve of the drum with no paper attached. This curve was plotted for a typical drum having a specific layout of slots and holes. Curve 126 represents the characteristic curve for a drum having one sized type of paper attached thereto. The operating point of the system occurs at the intersection where the vacuum pump characteristics curve and the blower characteristics curve intersects the no-load and load drum characteristics curve, respectively. As can be seen from the figure, at point 3 the drum's no-load paper characteristics curve intersects the blower curve. By running a horizontal line from this point to the ordinate of the graph, the effective vacuum which is present in the drum's slots is determined. Likewise, point 4 indicates the operating point for the drum with paper on when a blower is used. Again, a horizontal line drawn from this point to the ordinate of the graph shows the effective pressure in the slot of the drum. As can be seen from the two pressures, the effective pressure between no-load and load conditions is substantially constant. This shows that for optimum operation a vacuum system including a blower having a relatively high flow with relatively low vacuum is very desirable.

Using a similar analysis, it can be shown that intersecting point 1 and intersecting point 2 identify the respective operating point of the drum when a prior art vacuum pump is used to evacuate the drum. It is also seen that there is a wide swing between the vacuum experienced in the drum between no-load and load condition. This is an undesirable condition and as such, the traditional vacuum pump is not suitable for use in the evacuating system of the paper transport system unless the drum is segmented and a vacuum relief mechanism is used.

The advantages associated with the document transported of the present invention, may be summarized as follows:

The system is simple and low cost, which provides high reliability and fast response.

The system requires no valving or internal segmentation for controlling the vacuum in the drum. The population and/or size of the holes control the flow and provide the source of vacuum to the slots when covered.

Another advantage of the present invention is that it enables different size sheets of flexible material to be handled by a nonsegmented vacuum drum.

While the invention has been particularly shown and described with reference to a preferred embodiment thereof, it will be understood by those skilled in the art that various changes in form and details may be made therein without departing from the spirit and scope of the present invention.

What is claimed is:

1. In a document transport system wherein flexible rectangular sheets are loaded in seriatim onto a transport mechanism for transport through a processing station, and are unloaded from said transport mechanism, the improvement comprising:

a transport mechanism including a low inertia rotary vacuum drum;

said rotary vacuum drum having a cylindrical surface for supporting the sheets;

said cylindrical surface having a plurality of elongated slots with a plurality of communicating ports disposed in said slots, said elongated slots being configured into groups with each group having a different population of communicating ports and operable to generate different pressure zones on said surface;

a low vacuum, high flow blower operable to evacuate the interior of said drum; and a motor coupled to said drum and operable to rotate the drum.

2. The document transport system of claim 1 wherein the population of the communicating ports is relatively high at a first zone and a third zone whereat leading edge and a trailing edge of the sheet are being attached and relatively low at a second zone intermediate the first zone and the third zone.

3. The document transport system of claim 1 wherein the population of the communicating ports at the third zone is relatively higher than the population of the communicating ports at the first zone.

4. An apparatus for transporting variable size rectangular flexible sheets comprising:

a low inertia drum journaled for rotation about an axis with a cylindrical surface for supporting the sheets;

said cylindrical surface having a plurality of elongated slots being disposed in spaced rows along the longitudinal dimension and about the circumferential dimension of said drum;

said slots further being configured into longitudinal and circumferential sets of slots with each set being operable to support a different size sheet;

a plurality of communicating ports disposed in said slots and operable to communicate vacuum from the interior of said drum to the cylindrical surface, said communicating ports having different population groupings to create different pressure zones on the cylindrical surface; and means for supplying the vacuum to said drum.

5. The apparatus of claim 4 wherein the longitudinal set of slots are configured to support three sizes of sheets and the circumferential slots are configured to support two sizes of sheets.

6. The apparatus of claim 5 wherein the circumferential slots include a leading edge slot operable to support a leading edge of the sheet; and a pair of trailing edge slots, with each slot being operable to support a different size sheet.

7. A transport drum operable for use in a printing device or other document transport, comprising:

a low inertia cylindrical member with a cylindrical surface for supporting the document;

said cylindrical surface having a plurality of longitudinal slots, said slots being configured in linear rows and operable to support variable size documents;

a pair of disc members disposed at opposite ends of the cylindrical member and fixedly joined to said member;

a vacuum communicating tube disposed in one of the end members; and a plurality of communicating ports disposed in the slots, said ports having variable numbers and/or sizes in different slots to generate different pressure zones on said surface.

* * * * *